US008187409B2

(12) United States Patent
Anderson

(10) Patent No.: US 8,187,409 B2
(45) Date of Patent: May 29, 2012

(54) WINDOW SASH PAINT REPLACEMENT TAPE APPLICATION TOOL AND METHOD

(75) Inventor: Gordon L. Anderson, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 90 days.

(21) Appl. No.: 12/375,689

(22) PCT Filed: Aug. 10, 2007

(86) PCT No.: PCT/US2007/075694

§ 371 (c)(1),
(2), (4) Date: Jan. 30, 2009

(87) PCT Pub. No.: WO2008/022027

PCT Pub. Date: Feb. 21, 2008

(65) Prior Publication Data

US 2009/0260741 A1 Oct. 22, 2009

Related U.S. Application Data

(60) Provisional application No. 60/822,062, filed on Aug. 10, 2006, provisional application No. 60/868,505, filed on Dec. 4, 2006, provisional application No. 60/896,378, filed on Mar. 22, 2007.

(51) Int. Cl.
*B65H 37/04* (2006.01)

(52) U.S. Cl. ..... 156/297; 156/391; 156/475; 156/486; 156/540; 156/543; 156/574; 156/579

(58) Field of Classification Search ..... 156/297, 156/391, 475, 486, 540, 543, 574, 579
See application file for complete search history.

(56) References Cited

U.S. PATENT DOCUMENTS

| | | | |
|---|---|---|---|
| 6,508,287 | B1 | 1/2003 | Shinozaki et al. |
| 2005/0000658 | A1 | 1/2005 | Fujiwara |

FOREIGN PATENT DOCUMENTS

| | | |
|---|---|---|
| GB | 2331286 | 5/1999 |
| JP | 2002331976 | 11/2002 |
| JP | 2003063729 | 3/2003 |
| JP | 2003285970 | 7/2003 |
| WO | WO 2005/032991 | 4/2005 |

*Primary Examiner* — Katarzyna Wyrozebski Lee
*Assistant Examiner* — Joshel Rivera

(57) ABSTRACT

A tape application tool (30) that can hold an adhesive-backed paint replacement tape in position relative to a window frame (34), as well as apply at least the sash section of the tape to the sash portion of the window frame, without having to use a separate location tool and without having to use a paint replacement tape that includes a removable location tab. The tool comprises at least one tape application roller (58), at least one or more guide rollers (66,68), a biasing mechanism, at least one first tape locating surface (54) and, optionally, a tool stop surface (44).

13 Claims, 6 Drawing Sheets

WINDOW SASH PAINT REPLACEMENT TAPE APPLICATION TOOL AND METHOD

CROSS REFERENCE TO RELATED APPLICATIONS

This application is a national stage filing under 35 U.S.C. 371 of PCT/US2007/075694, filed Aug. 10, 2007, which claims priority to Application No. 60/822,062, filed Aug. 10, 2006, the disclosure of which is incorporated by reference in its/their entirety herein.

This application claims the benefit of U.S. Provisional Patent Application No. 60/822,062, filed Aug. 10, 2006, 60/868,505, filed Dec. 4, 2006, and 60/896,378, filed Mar. 22, 2007, the disclosures of which are incorporated by reference herein in their entirety.

FIELD

The present invention relates to tools used to apply adhesive-backed paint replacement film and, in particular, to such tools for applying a paint replacement tape to the sash portion of a vehicle door window.

BACKGROUND

Adhesive-backed decorative films have been used instead of conventional liquid paint in coloring or otherwise decorating portions of an automobile or other vehicle body. One use of such paint replacement film, for example, has been to paint the sash and pillar portions that frame the window of an automobile door. For such applications, adhesive-backed paint replacement films in tape form have been used that include a sash section and a pillar section corresponding, respectively, to the generally horizontal sash portion and generally vertical pillar portion of the window frame. Such tapes are typically die cut out of sheets of the desired adhesive-backed decorative film. The adhesive used is typically a pressure sensitive adhesive. The conventional practice of applying such adhesive-backed tape has been to first use a location tool that holds the adhesive-backed tape in the proper location for application to the window frame. After it is located, the pillar section of the tape is usually the first part to be applied/adhered to the window frame, typically by hand with a squeegee. Once the pillar section of the tape is adhered to the pillar portion of the window frame, the location tool is removed and a sash application tool is attached to the window frame and used to apply the sash section of the tape to the sash portion of the window frame. The application tool removes the liner from the tape while it rolls along the sash section of the tape so as to adhere this section of the tape onto the window sash.

Instead of using two tools to accomplish both operations, the tape application tool disclosed in Japanese Kokai Published Patent Application No. 2003063729 is able to combine such location and application procedures using one tool that includes features capable of accomplishing both functions. The tape applied using this tool includes a removable tab feature (e.g., the hook-shaped tape structure 5*d* shown in FIGS. 1 and 4 of the 2003063729 Japanese patent application) that is used to secure the location of the tape relative to the window frame, during the application of the sash section of the tape to the sash portion of the window frame. The tape has a two part release liner, one part protects the sash section of the tape and the other protects the pillar section of the tape. The tool removes the sash section of the liner as the tool applies/adheres the sash section of the tape. After the sash section of the tape is applied/adhered, the tool is removed.

Next, the pillar section of the liner is removed, and the pillar section of the tape is applied/adhered by hand to the pillar of the window frame, typically using a squeegee. After the sash and pillar sections of the tape have been applied/adhered to the door window frame, the tab is torn off.

There is a continuing need to simplify and expedite the application of such tapes to the window frame of automobile doors as well as other vehicle doors.

SUMMARY OF THE INVENTION

The present invention provides a tape application tool that is easier to use and can allow coloring (e.g., liquid paint replacement) or otherwise decorative tapes to be more quickly applied/adhered to a body frame including, for example the window frame of a door (e.g., an automobile door). With the present inventive tape application tool, the cost of using such tapes can also be reduced.

The use of a paint replacement tape with a location tab, as taught in the prior art, can have detrimental affects. For example, having to account for the additional paint film needed to form the location tab can reduce the number of tape patterns (e.g., each pattern having a sash section and pillar section) that can be die cut from a given sheet (i.e., area) of adhesive (psa) backed paint replacement film and, in this way, increase the amount of scrap paint film generated. By eliminating the need for such a location tab, the present invention can allow for tighter nesting of (i.e., reduced gap between) the tape patterns, which can reduce the amount of paint film (i.e., the paint film located between the nested tape patterns) that is wasted.

In accordance with one aspect of the present invention, a tape application tool is provided that can hold the adhesive-backed paint replacement tape in position relative to the window frame, as well as apply at least part of the tape to a portion of the window frame (e.g., the sash section of the tape to the sash portion of the window frame), without having to use a separate location tool and without having to use a paint replacement tape that includes a removable location tab. In one embodiment, the present tape application tool uses the inside corner of a generally L-shaped tape, where the sash and pillar sections of the tape come together, to secure the tape to the application tool and, thereby, enable the tape to be held in the desired position relative to the tool.

In accordance with another aspect of the present invention, a tool is provided for applying at least part of an adhesive-backed coloring or otherwise decorative tape (e.g., paint replacement film) to a window frame of a vehicle door. The window frame can have a front surface on which the tape is to be adhered, a back surface opposite the front surface and an inside edge that typically at least partially defines the window opening. The tape has a shape corresponding to a least a portion of the window frame, an inside peripheral edge and a front or top coloring (e.g., paint replacement) or otherwise decorative surface opposite an adhesive back surface, (e.g., the window frame can have a sash portion and a pillar portion that form a generally L-shape, with the tape having a corresponding L-shape with a sash section and pillar section, where the inside and outside peripheral edges of the sash section are a lower and upper peripheral edge, respectively). Preferably, the adhesive-backed tape forms part of a tape assembly that further comprises a release liner (e.g., using conventional release liner technology) releasably bonded to the adhesive back surface of the tape. This tool comprises at least one tape application roller, at least one or more (e.g., two) guide rollers, a biasing mechanism, at least one first tape locating surface and, optionally, a tool stop surface.

The at least one tape application roller is dimensioned, designed or otherwise operatively adapted for applying at least part of the tape to the front surface of the window frame, for example by being made with a surface that is elastic (e.g., made of an elastomeric material like, for example, a solid or foam rubbery material). The tape application roller has a lower end region and an upper end region. The at least one guide roller is dimensioned, designed or otherwise operatively adapted for engaging the back surface of the window frame. The biasing mechanism is dimensioned, designed or otherwise operatively adapted for biasing the at least one tape application roller and the at least one guide roller towards each other, and further dimensioned, designed or otherwise operatively adapted to allow the biasing of the biasing mechanism to be overcome such that the at least one tape application roller and the at least one guide roller can be separated from each other, preferably, with hand pressure from only one hand of an operator. For example, the biasing mechanism can comprise one or more springs (e.g., one or more torsion springs) that are oriented so as to bias the tape application roller(s) and the guide roller(s) together, with the spring(s) having a strength that can be overcome with hand pressure. The at least one first tape locating surface is located adjacent the lower end region of the tape application roller.

The at least one first tape locating surface is dimensioned, designed or otherwise operatively adapted for receiving (e.g., by resting) thereon a first part of the inside peripheral edge (e.g., a part of the lower peripheral edge of the sash section) of the tape such that, after the tool is attached to the window frame, a section (e.g., the sash section) of the tape can be located at a corresponding portion (e.g., the sash portion) of the window frame. For example, the inside peripheral edge (e.g., the lower peripheral edge of the sash section) of the tape can be located so as to rest on the first tape locating surface. After an initial part (e.g., of the section) of the located tape is adhered to a corresponding part (e.g., of the portion) of the window frame, the tool can be freely slid or otherwise moved along the corresponding portion (e.g., the sash portion) of the window frame while corresponding parts of the inside peripheral edge (e.g., the lower peripheral edge of the sash section) of the tape are received on the first tape locating surface. Preferably, the present tool further comprises at least one second tape locating surface dimensioned, designed or otherwise operatively adapted for a second part of the inside peripheral edge (e.g., a part of the inside peripheral edge of the pillar section) of the tape to be located (e.g. contact) against the second tape locating surface, at least during the initial application of the tape to the window frame. Preferably, this second tape locating surface is located at the bottom of, or otherwise within, a notch (e.g., a slit) dimensioned, designed or otherwise operatively adapted for the second part of the inside peripheral edge to be disposed within the notch or slit.

The optional tool stop surface is dimensioned, designed or otherwise operatively adapted for contacting the inside peripheral edge of the window frame so as to locate the tool, and thereby the tape located on the tool, at a desired location relative to the window frame.

It can be desirable for the lower tape guide to be readily removable and replaceable with a different lower tape guide. Likewise, it can be desirable for the block to be readily removable and replaceable with a different block. Such a lower tape guide and such a block can be mechanically fastened to the tool with a removable fastener. In addition, the number of tool stop surfaces used can be equal to the number of vehicle doors with a window frame. Likewise, the number of first tape locating surfaces can be equal to the number of vehicle doors with a window frame. Furthermore, the block can be a movable block that can be repositioned relative to the rest of the tool such that the movable block can be moved out of the way of an obstacle on the vehicle door, where the block would otherwise contact the obstacle and prevent the tool from completely applying the part of the adhesive-backed decorative tape to the window frame of the vehicle door.

In an additional aspect of the present invention, a method is provided for applying at least part of an adhesive-backed coloring or otherwise decorative tape (e.g., a paint replacement film) to a window frame of a vehicle door. The method comprises providing a window frame, providing a tape and providing the tool described above. The window frame has a front surface, a back surface opposite the front surface, and an inside edge. The tape has a shape corresponding to a least a portion of the window frame, an inside edge and a front or top coloring (e.g., paint replacement) or otherwise decorative surface opposite an adhesive back surface. The method further comprises overcoming the biasing of the biasing mechanism so as to separate the at least one tape application roller and the at least one guide roller apart; disposing the window frame between the separated at least one tape application roller and at least one guide roller; disposing the tape within the tool such that a first part of the inside peripheral edge (e.g., a part of the lower peripheral edge of the sash section) of the tape is positioned so as to be received (e.g., so as to rest) on at least one first tape locating surface; and applying the at least one tape application roller so as to adhere a section of the tape to at least a portion of the front of the window frame.

The method can further comprise allowing the biasing of the biasing mechanism to bring the at least one tape application roller and the at least one guide roller toward each other such that the window frame is sandwiched or otherwise engaged therebetween, with the at least one tape application roller engaging the front surface of the window frame and the at least one guide roller engaging the back surface of the window frame.

By not requiring the use of a separate location tool, the present invention can reduce the amount of time needed to apply the paint replacement tape to the window frame. By eliminating the need for a location tab on the tape, the present invention can enable a tighter nesting of (i.e., reduced gap between) tape patterns to be cut from a given area of adhesive-backed paint replacement film. Such a tighter nesting can increase the number of tapes that can be cut from a given sheet of the film and reduce the amount of film material wasted or scraped. By increasing the yield in this way, the cost of each piece of tape can be reduced.

By adapting the tool so as to include multiple tape locating surfaces, and preferably corresponding multiple tool stop surfaces, a single tool according to the present invention can be made to apply at least part of a tape to the window frames of multiple doors (e.g., 2, 4 or all doors) of the same vehicle (e.g., an automobile). With such a tool, additional time can be saved because an operator does not need to switch tools for each door. There is also additional cost savings associated with purchasing only one tool rather than multiple tools.

DETAILED DESCRIPTION OF AN EMBODIMENT OF THE PRESENT INVENTION

Figure 1:
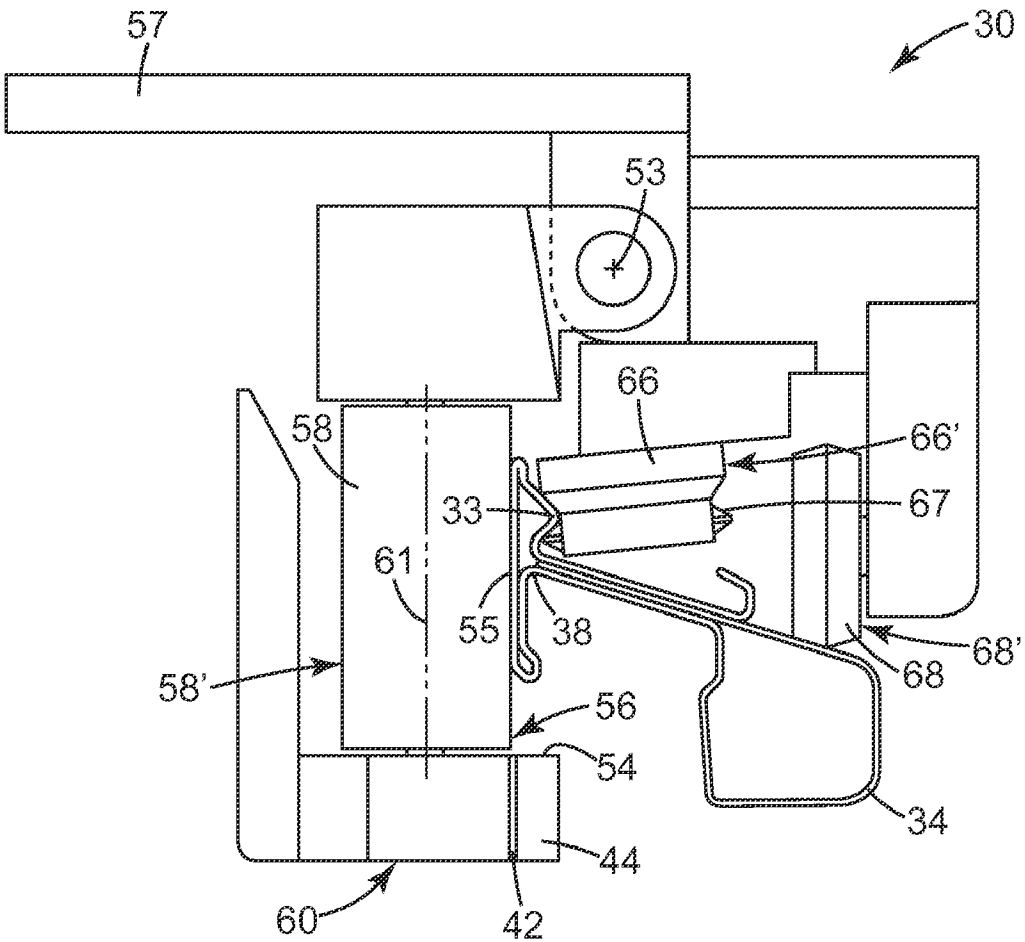
FIG. 1 is side plan view of one embodiment of a tool for applying part of a paint replacement tape to the sash portion of a window frame, according to the present invention, with the sash portion of the vehicle window frame shown in cross section.
Figure 2:
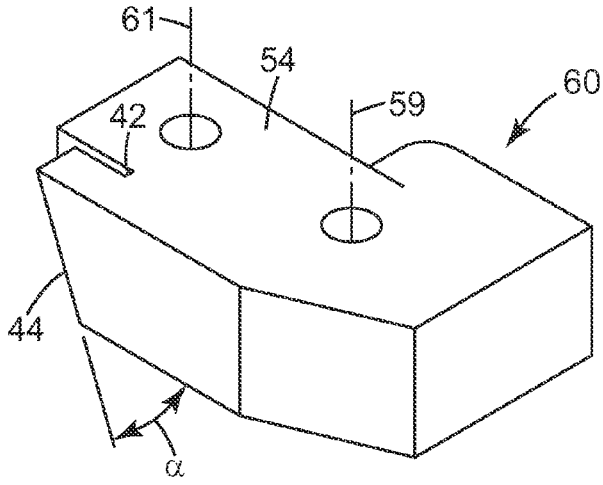
FIG. 2 is a perspective view of a lower tape guide block forming part of the tool of FIG. 1.
Figure 3:
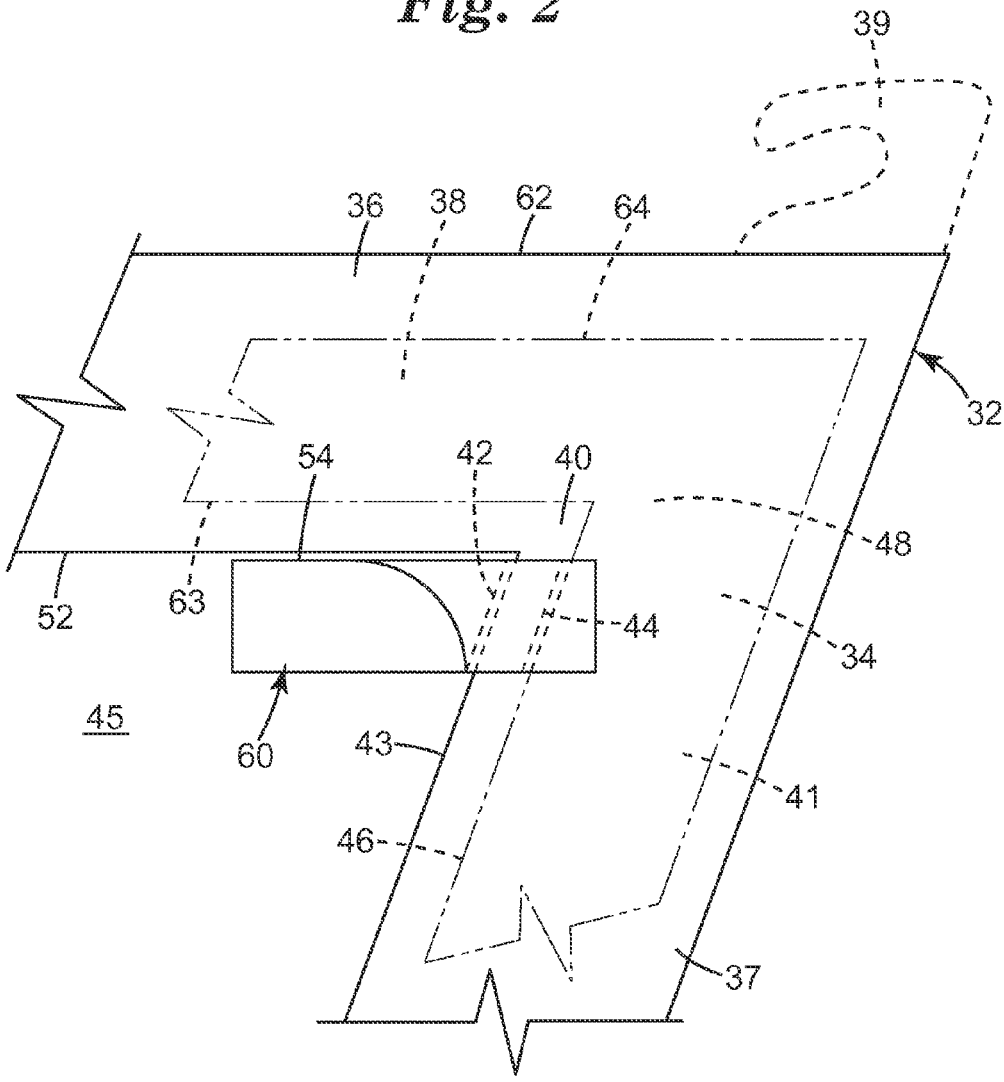
FIG. 3 is a side plan view of the lower tape guide block of FIG. 2 in a desired relation to a paint replacement tape and a vehicle window frame, in accordance with the principles of the present invention.

Referring to FIGS. 1-3, the present invention provides a tape application tool 30 that can hold an adhesive-backed paint replacement tape 32 in position relative to the window frame 34 of a vehicle door. The tape 32 has a sash section 36 and a pillar section 37. The tool 30 is also able to apply at least the sash section 36 of the tape 32 to the front surface 55 of the sash portion 38 of the window frame 34, without having to use a separate location tool and without having to use a paint replacement tape that includes a removable location tab 39 (shown in phantom on FIG. 3). The pillar section 37 of the tape 32 can be applied by hand (e.g., with a squeegee) to the pillar portion 41 of the window frame 34.

Referring to FIGS. 2 and 3, one embodiment of the present tape application tool 30 uses the inside corner 40 of a generally L-shaped tape 32, where the sash and pillar sections 36 and 37 of the tape 32 come together, to locate the tape 32 relative to the application tool 30. Once the tape 32 is located relative to the tool 30, the tape 32 can be held in a desired position relative to the window frame 34, by locating the tool 30 relative to the window frame (see below discussion). To locate the tape 32 relative to the tool 30, the tool 30 includes a first or upper tape locating surface 54 on which a part of the inside or lower peripheral edge 52 of the sash section 36 of the tape 32 rests. Preferably, the tool 30 also includes an additional tape locating surface, for example, in the form of a notch (e.g., a slot or slit) having a bottom surface 42 operatively adapted (i.e., dimensioned and shaped) for receiving therein part of the inside peripheral edge 43 of the pillar section 37 near the inside corner 40 of the tape 32. In contrast, the tool disclosed in the Japanese Kokai Published Patent Application No. 2003063729, which is incorporated by reference here in its entirety, locates an L-shaped tape to its tool using a hook-shaped location tab 5*d* on the upper corner of the tape (see FIG. 1 in this Japanese patent application) at the top of the pillar section of the tape.

The tool 30 includes two tape application rollers 58' and 58 operatively adapted for applying the tape 32 to the front surface 55 of the window frame 34. As illustrated in the drawings, roller 58' is located directly behind roller 58. Each of the rollers 58' and 58 rotates around a central axis 59 and 61, respectively. The roller 58 has a lower end region 56. The tool 30 also includes one lower guide roller 67 disposed between two upper guide rollers 66,66' (roller 66' is behind roller 66) that are operatively adapted for engaging a flange 33 on the back of the window frame 34. In particular, the guide roller 67 contacts and engages a lower portion of the flange 33 and the guide rollers 66,66' contact and engage an upper portion of the flange 33. The tool further includes a biasing mechanism such as, e.g., a torsion spring (not shown) that is operatively adapted for biasing and pivoting the tape application rollers 58',58 and the guide rollers 66,66',67 toward each other and around the axis 53. The tool 30 is also operatively adapted, for example, with a lever arm 57 that allows the biasing of the biasing mechanism to be overcome such that the tape application rollers 58',58 and the guide rollers 66,66',67 can also be separated from each other such that the surface 55 and the flange 33 can be readily disposed therebetween. In addition, the tool 30 includes a pair of rollers or wheels 68,68' that help to stabilize the tool 30 as it moves along the sash portion 38 of the frame 34. In the drawings, wheel 68' is located behind wheel 68.

The tape locating surface 42 is located on a lower side portion of the tool 30 adjacent to the lower end 56 of the tape application roller 58. In particular, for the embodiment of FIGS. 1-3, the tape locating surfaces 54 and 42 are formed in a trailing side or rear portion of the lower tape guide 60 and both tape locating surfaces 42 and 54 are disposed under the front surface 55 of the sash portion 38 of the window frame 34. The surface 42 is formed at an angle $\alpha$ (e.g., 70°) that preferably matches the angle between the sash section 36 and the pillar section 37 of the tape 32. The angle $\alpha$ may also be the same as the angle between the sash portion 38 and pillar portion 41 of the frame 34. The surface 42 is also formed at a depth (e.g., 4.5 mm) that enables the inside edge 43 of the pillar section 37 of the tape 32 to extend beyond the window frame 34 so as to overhang into the space or opening 45 for the door window defined by the window frame 34.

Such adhesive-backed tapes 32 typically have at least a sash section 36, as well as a pillar section 37, that is dimensioned wider than the corresponding portion of the window frame 34 to facilitate application of the tape 32 around the edges and to the back surface of the frame 34. In this way, for example, the inside peripheral edge 52 and outside peripheral edge 62 of the tape sash section 36 can each be curled/bent over and around respective edges 63 and 64, and each adhered to the corresponding back surface, of the sash portion 38 of the frame 34. Therefore, by allowing the inside peripheral edge 52 of the tape sash section 36 to overhang beyond the corresponding lower inside edge 63 of the window frame 34, the tool 30 can be used to initially apply/adhere the tape sash section 36 to the frame sash portion 38, while maintaining enough of an overhang of the tape 32 to, afterwards, allow at least one, and if desired both, of the peripheral edges 52 and 62 of the tape sash section 36 to be curled/bent around and adhered to the back surface of the window frame 34.

In the present invention, the tool 30 also includes a tool stop surface 44 that uses the inside edge 46 of the frame pillar portion 41, near the upper inside corner 48 of the window frame 34 (i.e., where the sash and pillar portions 38 and 41 come together), to locate the tool 30 at a position on the window frame 34 where it is desired to apply/adhere the tape 32. Referring to FIGS. 2*a* and 2*b*, this stop surface 44 is located on a trailing side or rear portion of the lower tape guide 60 of the tool 30 adjacent to the surface 42 and is slanted at an angle that matches the angle between the sash portion 38 and the pillar portion 41 of the window frame 34. In the present embodiment, the surface 44 is slanted at the same angle α (e.g., 70°) as the surface 42, though this may be different for different tape and window frame designs. The surface 44 acts as a stop in contacting the inside pillar edge 46 of the frame 34. In this way, the stop surface 44 is used to adjust the side-to-side or horizontal location of the tool 30 and, thereby, that of the tape 32. The up-and-down or vertical location of the tool 30 and, thereby, that of the tape 32, can be adjusted and controlled by the design of the guide rollers, and corresponding support structure, that engage the back surface of the sash portion 38 of the window frame 34 (e.g., guide rollers 66,66',67,68,68' and their associated assemblies).

The tool stop surface 44, as well as the tape locating surfaces 54 and 42, can be located on a lower side portion of the tool 30 adjacent to the lower end 56 of the tape application roller 58. In particular, for the embodiment of FIGS. 1-3, the stop surface 44 and tape locating surfaces 54 and 42 are formed in a trailing side or rear portion of the lower tape guide 60 and disposed under the front surface 55 of the sash portion 38 of the window frame 34.

With the tape 32 accurately located in the tool 30 and the tool 30 accurately located on the door window frame 34, the tape 32 is accurately located for being applied/adhered to the window frame 34 of the vehicle door. In this way, an operator can hold the tape 32 in position near, for example, by pressing the tape against, the upper corner 48 of the window frame 34 and move the tool 30 down along the sash portion 38 of the frame 34 so as to apply/adhere the sash section 36 of the tape 32 to the front surface 55 of the sash portion 38. Once the sash section 36 of the tape 32 is applied, the tape pillar section 37 can be applied in a conventional manner (e.g., manually with a squeegee or a suitable pillar section application tool). Next, the overhanging edges of the tape 32 can be curled around the corresponding edge(s), and adhered to the back surface, of the pillar portion 41 of the window frame 34.

As described above, the tool 30 can be used to apply the tape 32 to the window frame 34 of one vehicle door (not shown). This same tool 30 can be easily adapted, however, for use in applying a different tape to the window frame of each of two, four or any number of doors by simply forming appropriately adapted (i.e., dimensioned and shaped) tape locating surfaces and, if desired, tool stop surfaces at appropriate locations corresponding to the particular door designs. This can be easily and cost effectively accomplished by so modifying only the lower tape guide 60. For example, four of the same tool 30 could be made but with a differently designed lower tape guide 60, each guide 60 having appropriately formed tool stop and tape locating surfaces, with one tool being used with each of the front left side door, front right side door, rear left side door and rear right side door of a vehicle such as, for example, a passenger automobile. In what follows, other embodiments of the present inventive tool are described and illustrated by the drawings. Since these embodiments include many elements which are substantially identical or at least similar to those shown in FIG. 1, such elements are indicated by the same numerals and are not explained in as much detail repeatedly herein.

Figure 4:
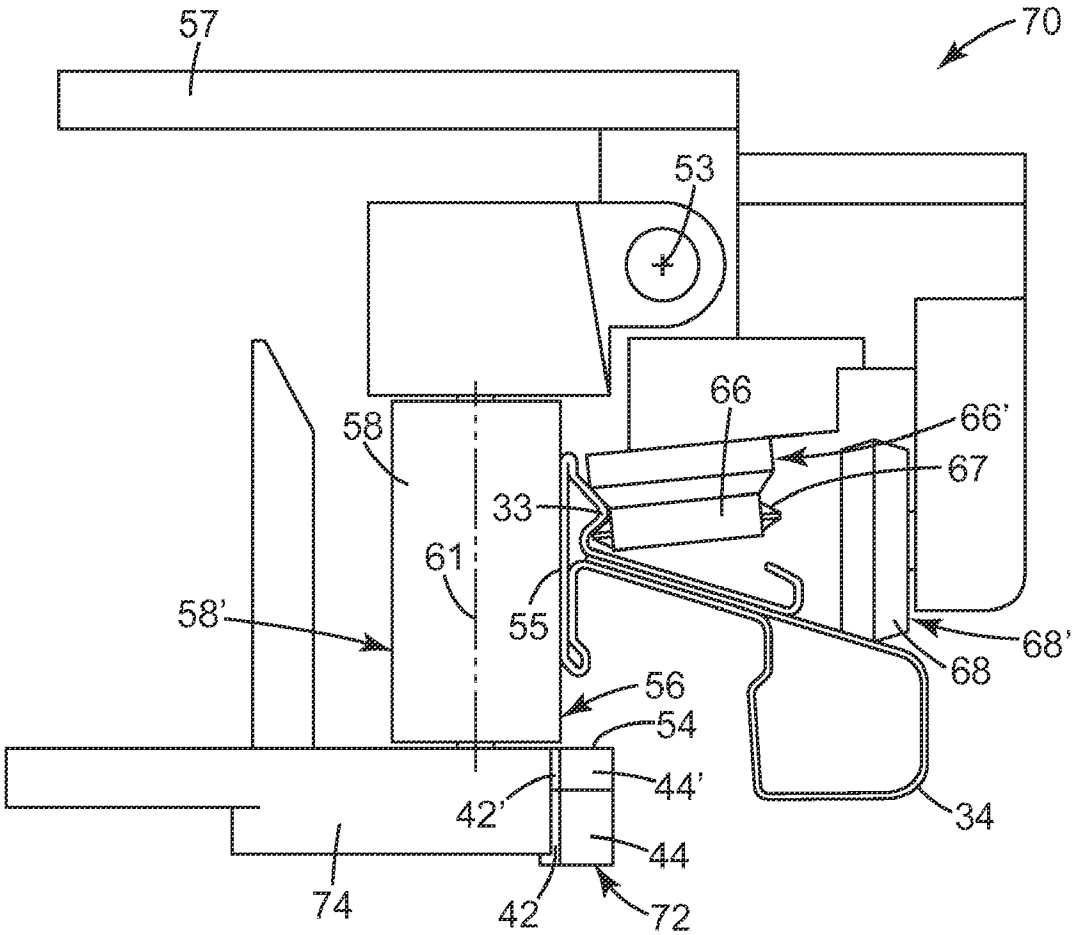
FIG. 4 is a side plan view of another embodiment of a tool for applying part of a paint replacement tape to the sash portion of a window frame, according to the present invention, with the sash portion of the vehicle window frame shown in cross section.
Figure 5:
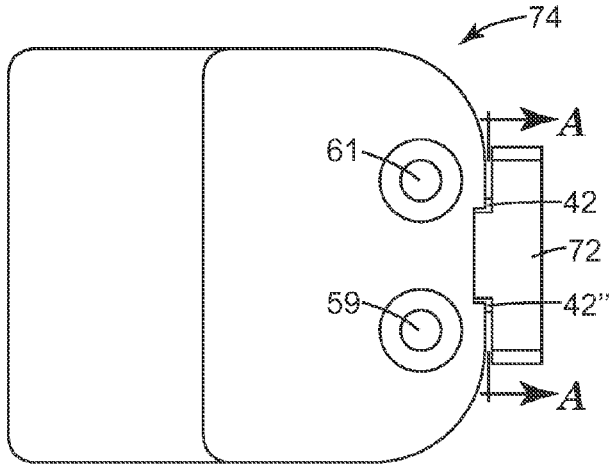
FIG. 5 is a bottom plan view of the lower tape guide and universal tape locating and tool stop block of the tool of FIG. 4.
Figure 6:
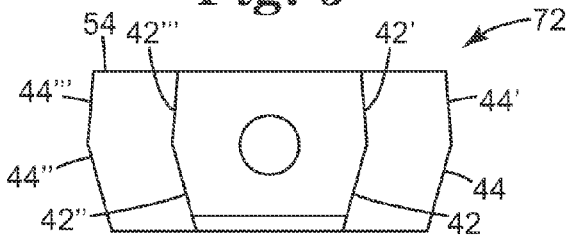
FIG. 6 is a plan view of the universal tape locating and tool stop block of the tool of FIG. 4 taken along line A-A.

Alternatively, the present tool can be even more easily and cost effectively modified, according to additional principles of the present invention, so that a single tool can be used to apply a different tape to the window frame of each of two, four or any number of doors. This can be accomplished by forming on the same tool all of the tape locating surfaces and, if desired, tool stop surfaces needed for each window frame. One embodiment of such a universal tool is shown in FIGS. 4-6 and indicated by reference number 70. A main difference between tool 70 and tool 30 is that tool 70 does not use a differently designed lower tape guide 60 to provide each set of appropriately formed tape locating surfaces and, if desired, tool stop surfaces. Instead, the tool 70 includes a tape location block 72 formed with a first tape locating surface 54 and multiple second tape locating surfaces 42, 42', 42", 42'''. If desired, block 72 also includes multiple corresponding tool stop surfaces 44,44',44",44'''. Thus, one block 72 can be used to provide the needs for each of four different window frames. The lower tape guide 74 of the illustrated tool 70 is operatively adapted (e.g., designed and dimensioned) to be used with any number of different blocks 72 (i.e., the tape guide 74 is not replaced). In this way, the tool 70 can be used not only for any number of the door window frames of a vehicle, but also for differently designed vehicles, simply by replacing the block 72 with a more appropriately adapted block.

Figure 8A:
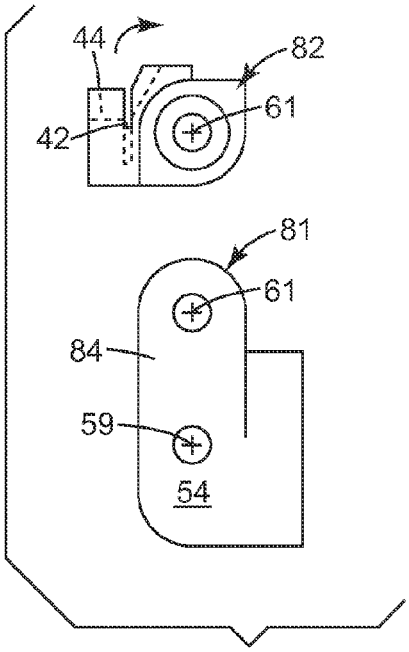
FIG. 8*a* is an exploded top plan view of a hinged stop block separated from a lower tape guide forming part of the tool of FIG. 7.
Figure 8B:
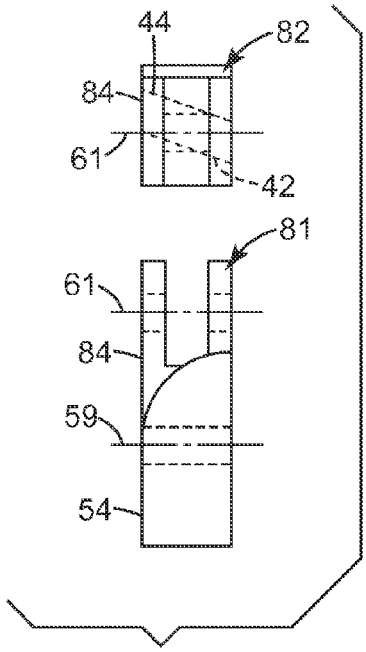
FIG. 8*b* is an exploded front plan view of the hinged stop block and lower tape guide of FIG. 8*a*.
Figure 7:
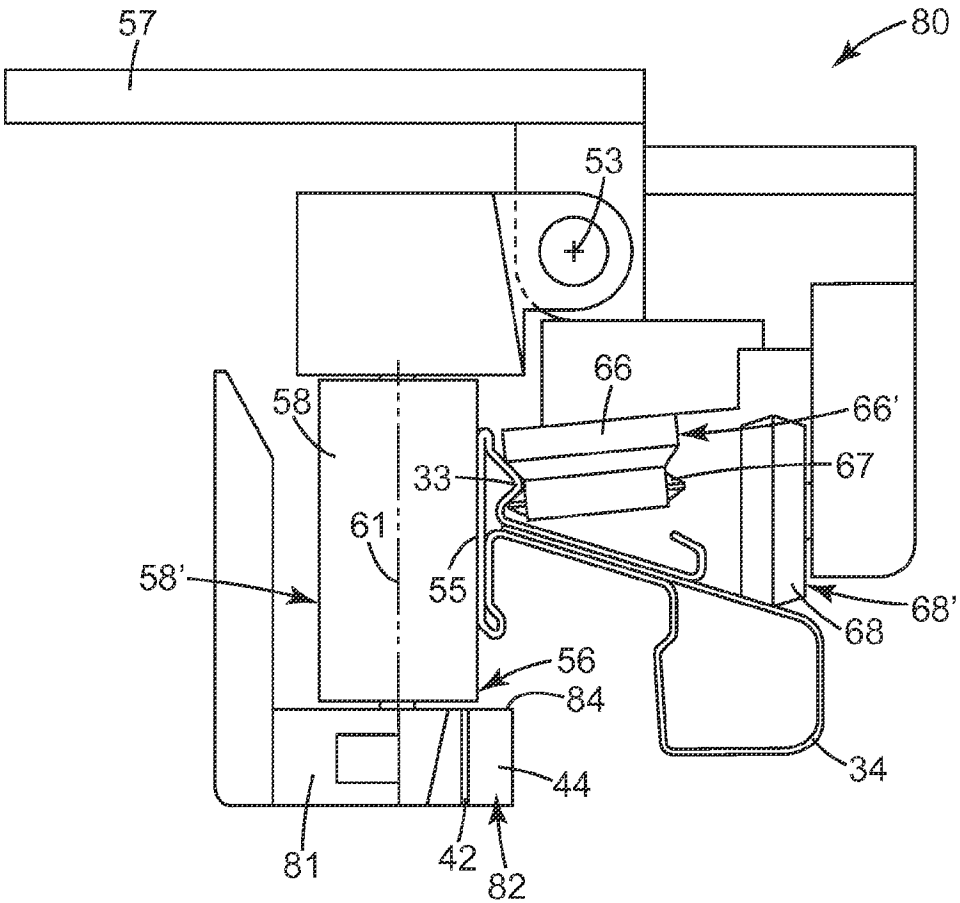
FIG. 7 is a side plan view of an alternative embodiment of a tool for applying part of a paint replacement tape to the sash portion of a window frame, according to the present invention, with the sash portion of the vehicle window frame shown in cross section.

Referring to FIGS. 7, 8*a* and 8*b*, instead of using a completely stationary tape location/stop block, like block 72 described above, the present invention can provide a tape application tool 80 that includes a lower tape guide 81 having a hinged block 82 that can be pivoted out of the way, around axis 61 (see the arrow in FIG. 8*a*), to clear a mirror post, division bar or other obstacle in the door window opening of, for example, an automobile. Like the tool 30, tool 80 includes an upper tape locating surface 84 on which a part of the inside or lower peripheral edge 52 of the sash section 36 of the tape 32 rests. The tape locating surface 84 is formed by an upper surface of both the lower tape guide 81 and the block 82. The hinged block 82 includes a tool stop surface 44 that is slanted at an angle that matches the angle between the sash portion 38 and the pillar portion 41 of the window frame 34. Preferably, the tool 80 also includes an additional tape locating surface, for example, in the form of a surface 42 at the bottom of a notch (e.g., a slot or slit) operatively adapted (i.e., dimensioned and shaped) for receiving therein a portion of the inside peripheral edge 43 of the pillar section 37 near the inside corner 40 of the tape 32. The surface 42 is preferably formed in the hinged stop block 82. The surface 42 is formed at an angle that matches the angle between the sash section 36 and the pillar section 37 of the tape 32, which may also be the same as the angle between the sash portion 38 and pillar portion 41 of the frame 34. The surface 42 is also formed at a depth (e.g., 4.5 mm) that enables the inside edge 43 of the pillar section 37 of the tape 32 to extend beyond the window frame 34 so as to overhang into the space 45 for the door window defined by the window frame 34. In this embodiment, the surface 44 is slanted at the same angle as the surface 42, though this may be different for different tape and window frame designs.

Figure 9:
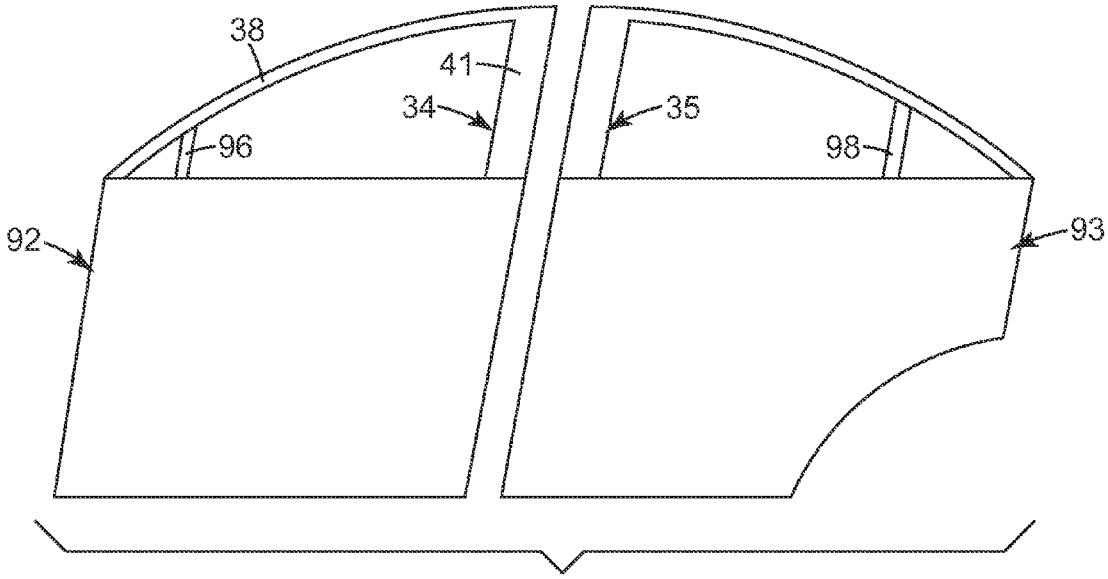
FIG. 9 is a plan view of an exemplary front and rear door of an automobile.

Referring to FIG. 9, a tape application tool (e.g., tools 30, 70 and 80) according to the present invention can be used to apply paint replacement tape on window frame 34 and 35 of both the front door 92 and back door 93 of a vehicle such as, for example, a passenger car. The hinged stop block 82 can be used to solve interference problems that can occur between a completely stationary block (e.g., block 72) and, for example, a division bar 96 in the window opening of, for example, the car door 92. With such an interference problem, and without the hinged block 82, the lower tape guides 60 and 72 of tools 30 and 70 could hit the division bar 96 before traveling and applying the tape 32 all the way to the front end of the sash portion 38 (i.e., before applying the free end of the tape 32). The hinged block 82 allows the tool 80 to locate the tape in the tool 80 and allows the tool 80 on the door 92 to extend into the window opening to stop against the window side of the pillar portion 41 of the window frame 34. Once the tape is located in the tool 80, the tool 80 is located on the door 92 and the application of the tape 32 down the sash is started, the stop surface 44 and tape locating surface 42 of the hinged block 82 are no longer needed. By making it hinged, the block 82 can be pivoted out of the way, allowing the tool 80 to be moved past the division bar 96, or other obstruction (e.g., division bar 98 of door 93), and apply the remaining portion of the tape 32 to the end of the sash portion 38 of frame 34.

The present tool is able to be accurately located on the door for accurate application/adhering of the tape to the window frame. At the same time, the present inventive tool eliminates the need for a separate location tool for the tape and eliminates the need for a removable location tab on the tape.

By eliminating the location tool, the operator has less tools to carry, keep track of and maintain. Having less tools means a lower capital investment associated with using such a painting process. In addition, the use of the present tool can speed up the tape application process, because the steps of installing and removing the location tool is eliminated. In addition, the present tool does not need a location tab on the tape. Eliminating such a location tab on the tape can improve the tape manufacturing yields, by allowing tighter nesting between tape patterns, which can reduce the overall cost of using such a paint replacement tape, making such tape more cost competitive compared to conventional liquid paint.

From the above disclosure of the general principles of the present invention and the preceding detailed description, those skilled in this art will readily comprehend the various modifications, re-arrangements and substitutions to which the present invention is susceptible. For example, the features disclosed herein of the tape location and tool stop surfaces are universal in the sense that they can be used in any number of tool designs, not just the specific tools 30, 70 and 80 illustrated and described herein. In addition, multiple tape location surfaces and tool stop surfaces, like those found on block 72, can be formed on a hinged or otherwise moveable block, like block 82.

Therefore, the scope of the invention should be limited only by the following claims and equivalents thereof.

The invention claimed is:

1. A tool for applying at least part of an adhesive-backed decorative tape to a window frame of a vehicle door, the window frame having a front surface, a back surface and an inside edge, the tape having a shape corresponding to a least a portion of the window frame, an inside peripheral edge and a top decorative surface opposite an adhesive back surface, and said tool comprising:

at least one tape application roller operatively adapted for applying at least part of the tape to the front surface of the window frame, said tape application roller having a lower end region and an upper end region;

at least one guide roller operatively adapted for engaging the back of the window frame;

a biasing mechanism operatively adapted for biasing said at least one tape application roller and said at least one guide roller towards each other, and further operatively adapted to allow the biasing of said biasing mechanism to be overcome such that said at least one tape application roller and said at least one guide roller can be separated from each other;

at least one first tape locating surface located adjacent the lower end region of said tape application roller, said first tape locating surface being operatively adapted for receiving thereon a first part of the inside peripheral edge of the tape such that, after said tool is attached to the window frame, a section of the tape can be located at a corresponding portion of the window frame; and comprising at least one second tape locating surface operatively adapted such that a second part of the inside peripheral edge of the tape can be located so as to contact against said second tape locating surface while the first part of the inside peripheral edge of the tape is received so as to contact on said first tape locating surface.

2. The tool according to claim 1, wherein the lower end region of said tape application roller is operatively adapted for engaging so as to apply an inside edge of the tape along a portion of the front surface of the window frame, and the upper end region of said tape application roller is operatively adapted for engaging so as to apply an outside edge of the tape along the portion of the front surface of the window frame.

3. The tool according to claim 1, wherein said biasing mechanism is operatively adapted to allow the biasing of said biasing mechanism to be overcome such that said at least one tape application roller and said at least one guide roller can be separated from each other with hand pressure from only one hand of an operator.

4. The tool according to claim 1, wherein the first part of the inside peripheral edge of the tape is a lower peripheral edge of a sash section of the tape, the second part of the inside edge of the tape is part of the inside peripheral edge of a pillar section of the tape, and said second tape locating surface is operatively adapted for the part of the inside peripheral edge of the pillar section of the tape to be located against said second tape locating surface while the part of the lower peripheral edge of the sash section of the tape is received on said first tape locating surface.

5. The tool according to claim 1, wherein said second tape locating surface is in a notch operatively adapted for receiving the second part of the inside peripheral edge of the tape therewithin.

6. The tool according to claim 1, further comprising at least one tool stop surface operatively adapted for contacting the inside edge of the window frame so as to locate said tool, and thereby the tape located on said tool, at a desired location relative to the window frame.

7. The tool according to claim 1, further comprising a tape location block located adjacent to the lower end region of said at least one tape application roller, with each said tape locating surface forming part of said tape location block.

8. The tool according to claim 7, wherein said block is a movable block that can be repositioned relative to the rest of said tool such that said movable block can be moved out of the way of an obstacle on the vehicle door, where said block would otherwise contact the obstacle and prevent said tool from completely applying the part of the adhesive-backed decorative tape to the window frame of the vehicle door, and wherein said movable block is a hinged block that can be pivoted about an axis to be moved out of the way of the obstacle.

9. The tool according to claim 1, wherein said tool is operatively adapted for applying at least part of an adhesive-backed decorative tape to a window frame of at least two doors of a vehicle, with said tool comprising a separate one of said first tape locating surface for each window frame.

10. The tool according to claim 1, wherein said tool is operatively adapted for applying at least part of an adhesive-backed decorative tape to a window frame of at least two doors of a vehicle, with said tool comprising a separate one of said second tape locating surface for each window frame.

11. A method for applying at least part of an adhesive-backed decorative tape to a window frame of a vehicle door, said method comprising:

providing a window frame having a front surface, a back surface and an inside edge;

providing a tape having a shape corresponding to a least a portion of the window frame, an inside edge and a top decorative surface opposite an adhesive back surface;

providing the tool according to claim 1;

overcoming the biasing of the biasing mechanism so as to separate the at least one tape application roller and the at least one guide roller apart;

disposing the window frame between the separated at least one tape application roller and at least one guide roller;

disposing the tape within the tool such that a part of the inside peripheral edge of the tape is positioned so as to be received on the first tape locating surface; and applying the at least one tape application roller so as to adhere a part of the tape to at least a portion of the front of the window frame.

12. The method according to claim 11, further comprising allowing the biasing of the biasing mechanism to bring the at least one tape application roller and the at least one guide roller toward each other such that the window frame is engaged therebetween, with the at least one tape application roller engaging the front surface of the window frame and the at least one guide roller engaging the back surface of the window frame.

13. The method according to claim 11, wherein said disposing the window frame further comprises disposing the tool on the window frame so as to be in position to apply at least part of the tape to a desired location on the front of the window frame.

* * * * *